US007541725B2

(12) United States Patent
Cho et al.

(10) Patent No.: US 7,541,725 B2
(45) Date of Patent: Jun. 2, 2009

(54) ELECTRON EMISSION DISPLAY INCLUDING A CATHODE HAVING RESISTANCE LAYER ELECTRICALLY CONNECTING ISOLATION ELECTRODES HAVING ELECTRON EMISSION REGIONS TO A LINE ELECTRODE

(75) Inventors: Jin-Hui Cho, Yongin-si (KR); Sang-Jo Lee, Yongin-si (KR); Sang-Ho Jeon, Yongin-si (KR); Sang-Hyuck Ahn, Yongin-si (KR); Su-Bong Hong, Yongin-si (KR); Byung-Gil Jea, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 416 days.

(21) Appl. No.: 11/541,037

(22) Filed: Sep. 29, 2006

(65) Prior Publication Data

US 2007/0159055 A1 Jul. 12, 2007

(30) Foreign Application Priority Data

Sep. 30, 2005 (KR) ..... 10-2005-0091988

(51) Int. Cl.

| | |
|---|---|
| ***H01J 1/14*** | (2006.01) |
| ***H01J 1/13*** | (2006.01) |
| ***H01J 19/06*** | (2006.01) |
| ***H01J 19/02*** | (2006.01) |
| *H01J 1/62* | (2006.01) |
| *H01J 63/04* | (2006.01) |

(52) U.S. Cl. ..... 313/311; 313/495; 313/309; 313/310

(58) Field of Classification Search ..... 313/495–497, 313/309–311

See application file for complete search history.

(56) References Cited

U.S. PATENT DOCUMENTS 5,786,659 A * 7/1998 Takagi et al. ..... 313/309
5,889,361 A * 3/1999 Wang et al. ..... 313/309

(Continued)

FOREIGN PATENT DOCUMENTS

EP 1 542 258 A2 6/2005

(Continued)

OTHER PUBLICATIONS

European Search Report dated Mar. 7, 2007, for EP 06121619.8 in the name of Samsung SDI Co., Ltd.

*Primary Examiner*—Mariceli Santiago
(74) *Attorney, Agent, or Firm*—Christie, Parker & Hale, LLP

(57) ABSTRACT

An electron emission device includes a substrate, cathode and gate electrodes placed on the substrate in an insulated manner, and electron emission regions electrically connected to the cathode electrodes. Each of the cathode electrodes includes a line electrode having a groove at one lateral side surface thereof, and isolation electrodes formed on the substrate exposed through the groove such that the isolation electrodes are isolated from the line electrode. The electron emission regions are placed on the isolation electrodes and a resistance layer electrically connects the isolation electrodes to the line electrode.

20 Claims, 6 Drawing Sheets

U.S. PATENT DOCUMENTS

| | | | | |
|---|---|---|---|---|
| 6,278,228 | B1 * | 8/2001 | Iwase et al. | 313/309 |
| 2004/0140756 | A1 | 7/2004 | Kang et al. | |
| 2005/0052108 | A1 | 3/2005 | Motoi et al. | |
| 2005/0242707 | A1 * | 11/2005 | Hwang | 313/497 |
| 2007/0046175 | A1 * | 3/2007 | Hwang | 313/496 |

FOREIGN PATENT DOCUMENTS

| | | | |
|---|---|---|---|
| EP | 1 542 258 | A3 | 9/2005 |
| EP | 1 708 226 | A1 | 10/2006 |

* cited by examiner

FIG. 6 [Prior Art]
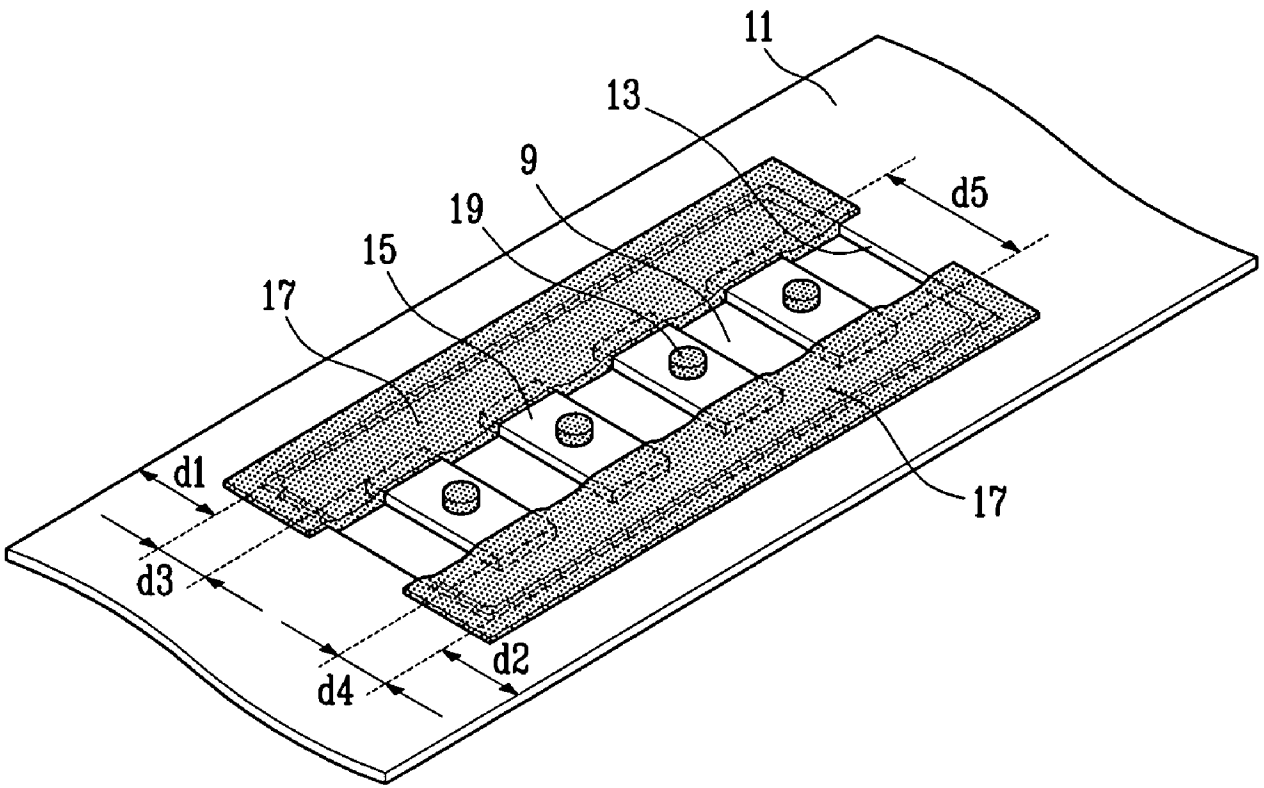

ELECTRON EMISSION DISPLAY INCLUDING A CATHODE HAVING RESISTANCE LAYER ELECTRICALLY CONNECTING ISOLATION ELECTRODES HAVING ELECTRON EMISSION REGIONS TO A LINE ELECTRODE

CROSS-REFERENCE TO RELATED APPLICATION

The application claims priority to and the benefit of Korean Patent Application No. 10-2005-0091988, filed on Sep. 30, 2005, in the Korean Intellectual Property Office, the entire content of which is incorporated herein by reference.

BACKGROUND OF THE INVENTION

1. Field of the Invention

The present invention relates to an electron emission device, and in particular, to an electron emission display that reduces a resistance by widening an effective width of driving electrodes, and improves a shape of the driving electrodes to achieve a high resolution display screen.

2. Description of Related Art

In general, an electron emission element can be classified, depending upon the kinds of electron sources, into a hot cathode type or a cold cathode type.

Among the cold cathode type of electron emission elements, there are a field emitter array (FEA) type, a surface conduction emission (SCE) type, a metal-insulator-metal (MIM) type, and a metal-insulator-semiconductor (MIS) type.

The FEA type of electron emission element includes electron emission regions, and cathode and gate electrodes that are used as the driving electrodes for controlling emission of electrons from electron emission regions. The electron emission regions are formed with a material having a low work function and/or a high aspect ratio. For instance, the electron emission regions are formed with a sharp-pointed tip structure that is formed with molybdenum (Mo) or silicon (Si), or a carbonaceous material such as carbon nanotube (CNT), graphite, and diamond-like carbon (DLC). With the usage of such a material for the electron emission regions, when an electric field is applied to the electron emission regions under a vacuum atmosphere (or vacuum state), electrons are easily emitted from the electron emission regions.

Arrays of electron emission elements are arranged on a first substrate to form an electron emission device. A light emission unit is formed on a second substrate with phosphor layers and an anode electrode, and is assembled with the first substrate to thereby form an electron emission display.

In the electron emission device, the plurality of driving electrodes functioning as the scanning and data electrodes are provided together with the electron emission regions to control the on/off of electron emission for respective pixels due to the operation of the electron emission regions and the driving electrodes, and also to control the amount of electrons emitted from the electron emission regions. The electrons emitted from the electron emission regions excite the phosphor layers to thereby emit light or display images.

With the above described electron emission device, an unstable driving voltage may be applied to an electrode (for convenience, hereinafter referred to as the "first electrode") electrically connected to the electron emission regions to supply the electric currents required for the electron emission, or the voltage applied to the electron emission regions may be differentiated due to a voltage drop of the first electrode. In this case, the emission characteristics of the electron emission regions become non-uniform so that light emission uniformity per respective pixels is deteriorated.

Accordingly, in order to solve such a problem, as shown in FIG. 6, opening portions 13 are internally formed at first electrodes 11 to expose a surface of a first substrate 9, and isolation electrodes 15 are formed within respective opening portions 13. Resistance layers 17 are formed between the first electrodes 11 and the isolation electrodes 15 at both ends of the isolation electrodes 15 to make the emission characteristics of electron emission regions 19 more uniform.

However, with the above-described structure of the first electrodes 11, the widths d1 and d2 of the first electrodes 11, the widths d3 and d4 of the respective resistance layers 17, and the width d5 of the isolation electrodes 15 should be contained in the width direction of the first electrodes 11 within the pixel areas where the electron emission regions 19 are located. Therefore, the effective width of the first electrodes 11 that can practically serve for the electric current flow is only the sum of d1 and d2.

Accordingly, with the above-structured electron emission device, a voltage drop inevitably occurs due to the increase in resistance pursuant to the reduction in an effective width. In the case that the effective width is enlarged to lower the resistance, it is difficult to achieve a high resolution display screen due to the enlargement in the width of the first electrodes.

SUMMARY OF THE INVENTION

It is an aspect of the present invention to provide an improved electron emission device that has a resistance layer on a plurality of first electrodes to make the emission characteristics of the electron emission regions more uniform, and that widens the effective width of the first electrodes to reduce resistance and achieves a high resolution display screen.

It is another aspect of the present invention to provide an electron emission display that uses the improved electron emission device.

According to an embodiment of the present invention, an electron emission device includes: a substrate; a plurality of cathode electrodes formed on the substrate; a plurality of gate electrodes insulated from the cathode electrodes; and a plurality of electron emission regions electrically connected to the cathode electrodes. Each of the cathode electrodes includes: a line electrode having a groove at one lateral side surface thereof; a plurality of isolation electrodes formed on the substrate exposed through the groove such that the isolation electrodes are isolated from the line electrode, the electron emission regions being placed on the isolation electrodes; and a resistance layer electrically connecting the isolation electrodes to the line electrode.

The resistance layer may be separately formed at the groove to connect the isolation electrodes to the line electrode, or may include a plurality of separate layers provided to the isolation electrodes to connect each of the isolation electrodes to the line electrode.

The isolation electrodes may be serially arranged along a longitudinal direction of the line electrode.

The line electrode may have protrusions at another lateral side surface thereof opposite to the groove. The protrusions may be placed at areas not corresponding to the groove.

A focusing electrode may be placed over the gate electrodes such that it is insulated from the gate electrodes.

According to another embodiment of the present invention, an electron emission display includes: an electron emission device having: a first substrate, a plurality of cathode electrodes formed with a plurality of gate electrodes on the first substrate such that the cathode electrodes and the gate electrodes are insulated from each other, and a plurality of electron emission regions electrically connected to the cathode electrodes. Each of the cathode electrodes includes: a line electrode having a groove at one lateral side surface thereof; a plurality of isolation electrodes formed on the first substrate exposed through the groove such that the isolation electrodes are isolated from the line electrode, the electron emission regions being placed on the isolation electrodes; and a resistance layer for electrically connecting the isolation electrodes to the line electrode. In addition, the electron emission display includes: a second substrate facing the first substrate; and a plurality of phosphor layers formed on a surface of the second substrate facing the first substrate.

In one embodiment, central portions of the phosphor layers along a longitudinal direction of the line electrode correspond to the electron emission regions.

BRIEF DESCRIPTION OF THE DRAWINGS

The accompanying drawings, together with the specification, illustrate exemplary embodiments of the present invention, and, together with the description, serve to explain the principles of the present invention.

FIG. 6 is a partial amplified plan view of an electron emission device according to a prior art.

DETAILED DESCRIPTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

Figure 1:
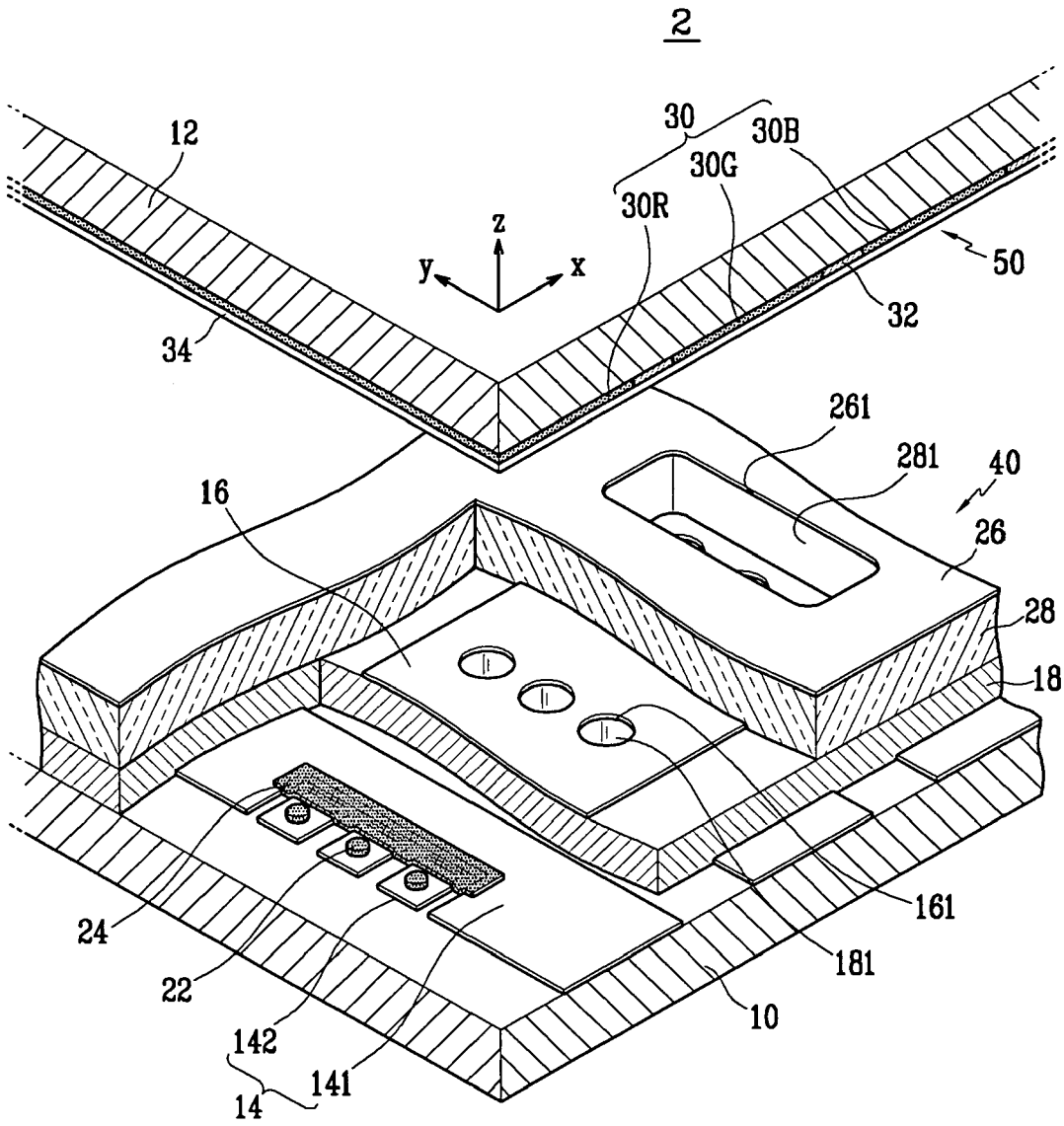
FIG. 1 is a partial exploded perspective view of an electron emission display according to a first embodiment of the present invention.
Figure 2:
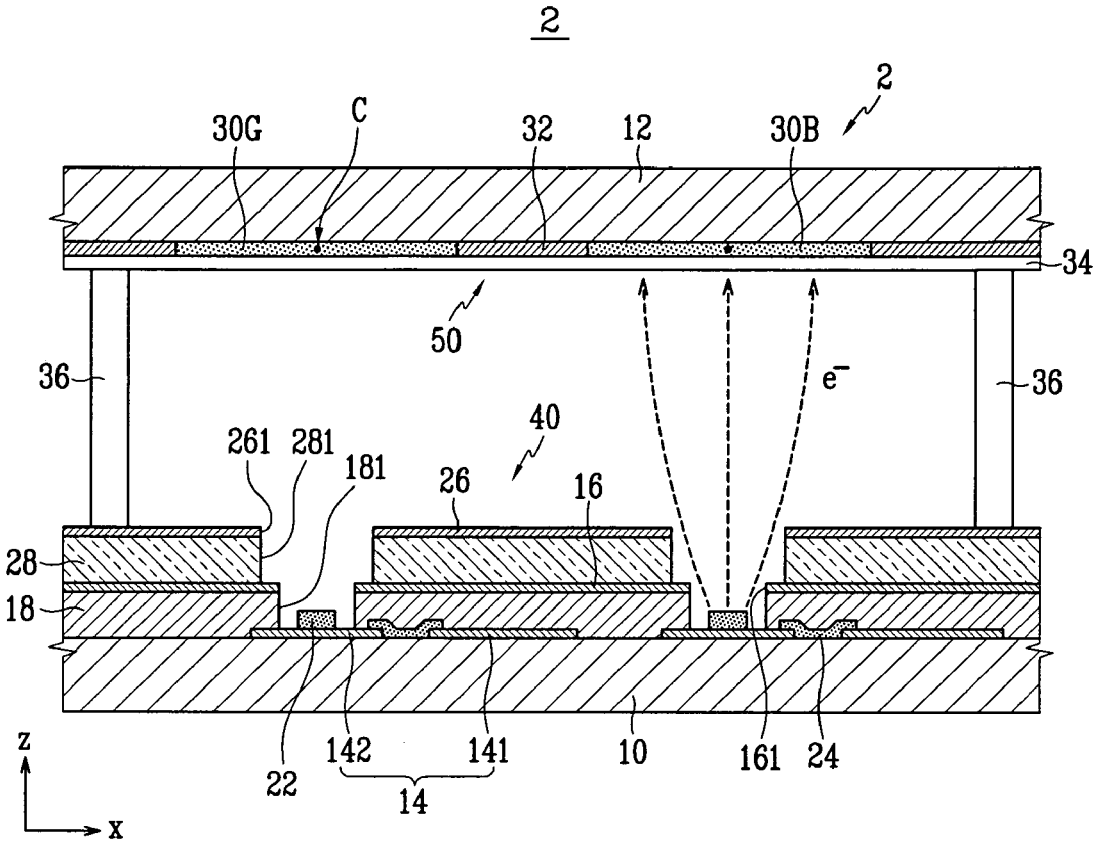
FIG. 2 is a partial sectional view of the electron emission display according to the first embodiment of the present invention.
Figure 3:
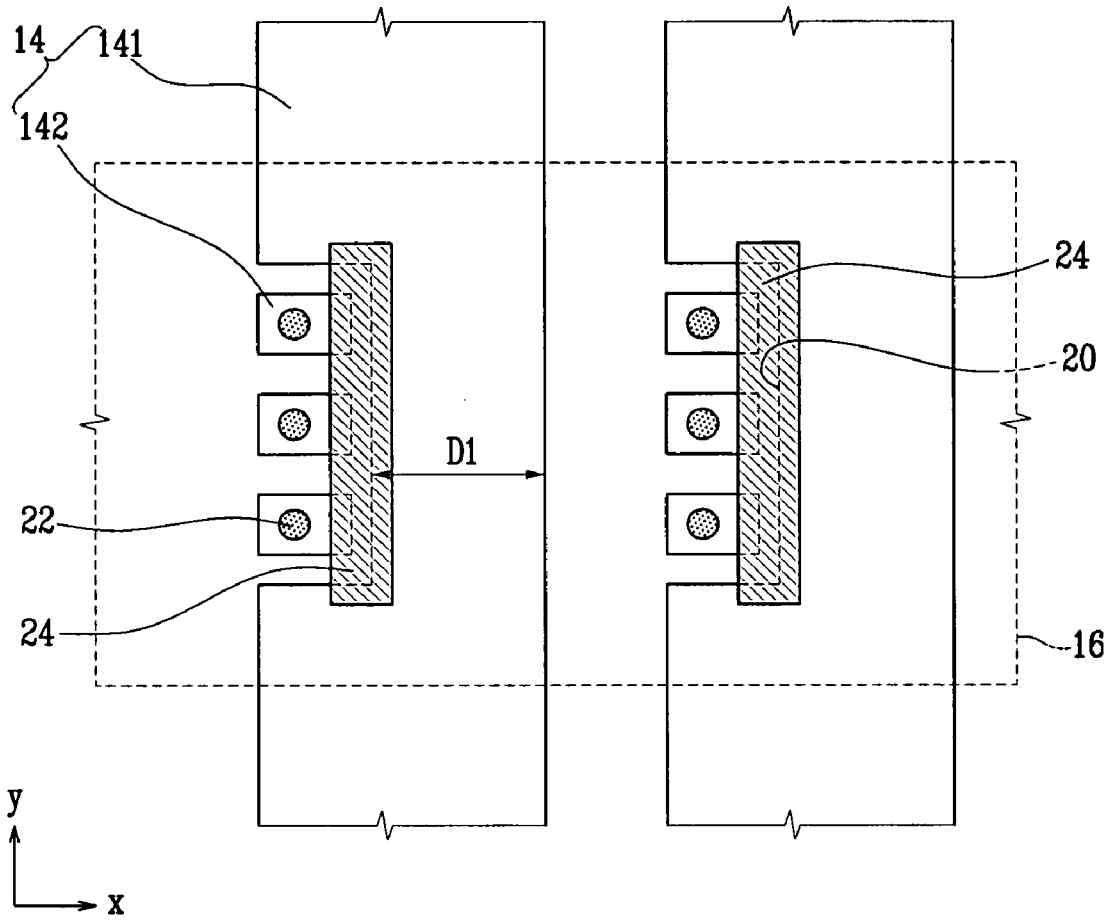
FIG. 3 is a partial amplified plan view of an electron emission device according to the first embodiment of the present invention.

FIGS. 1 and 2 are a partial exploded perspective view and a partial sectional view of an electron emission display 2 according to a first embodiment of the present invention, and FIG. 3 is a partial plan view of an electron emission device according to the first embodiment of the present invention.

As shown in FIGS. 1, 2, and 3, the electron emission display 2 includes a first substrate 10, and a second substrate 12 facing the first substrate 10 in parallel with a distance therebetween (wherein the distance therebetween may be predetermined). The first and second substrates 10 and 12 are sealed to each other at the peripheries thereof by way of a sealing member (not shown) to form a vessel, and the internal space of the vessel is evacuated to be at $10^{-6}$ Torr, thereby constructing a vacuum vessel (or chamber).

Arrays of electron emission elements are arranged on a surface of the first substrate 10 to form the electron emission device 40 together with the first substrate 10. The electron emission device 40 is assembled with the second substrate 12 and a light emission unit 50 provided thereon to form the electron emission display 2.

Cathode electrodes 14, referred to as the first electrodes, and gate electrodes 16, referred to as the second electrodes, are placed on the first substrate 10 such that they are insulated from each other. Line electrodes 141 of the cathode electrodes 14 are formed on the first substrate 10 in a direction (a direction of a y-axis in FIG. 3) of the first substrate 10, and a first insulating layer 18 is formed on the entire surface area of the first substrate 10 such that it covers the line electrodes 141. The gate electrodes 16 are stripe-patterned on the first insulating layer 18 perpendicular to the line electrodes 141.

In this embodiment, pixels are formed at the crossed regions of the line and gate electrodes 141 and 16, as shown in FIG. 3, and grooves 20 are formed at (or only at) one lateral side surface of the line electrodes 141 to expose the surface of the first substrate 10. One or more isolation electrodes 142 are formed in each groove 20 such that they are spaced away from the line electrode 141 at a certain (or predetermined) distance. In this embodiment, the isolation electrodes 142 are serially arranged at a certain (or predetermined) distance along the longitudinal direction of the line electrodes 141. The isolation electrodes 142 form the cathode electrodes 14 together with the line electrodes 141.

Electron emission regions 22 are formed on the isolation electrodes 142, and a resistance layer 24 is formed between the line and isolation electrodes 141 and 142. The resistance layer 24 is formed with a material having a specific resistivity ranging from 10,000 to 100,000 Ωcm, which is greater than that of a common conductive material. The resistance layer 24 electrically connects the line and isolation electrodes 141 and 142. The electron emission regions 22 receive the same-conditioned (or substantially the same-conditioned) voltage due to the presence of the resistance layer 24 even when an unstable driving voltage is applied to the line electrodes 141 or a voltage drop occurs at the line electrodes 141, thereby making the emission characteristics of the electron emission regions 22 more uniform.

Figure 4:
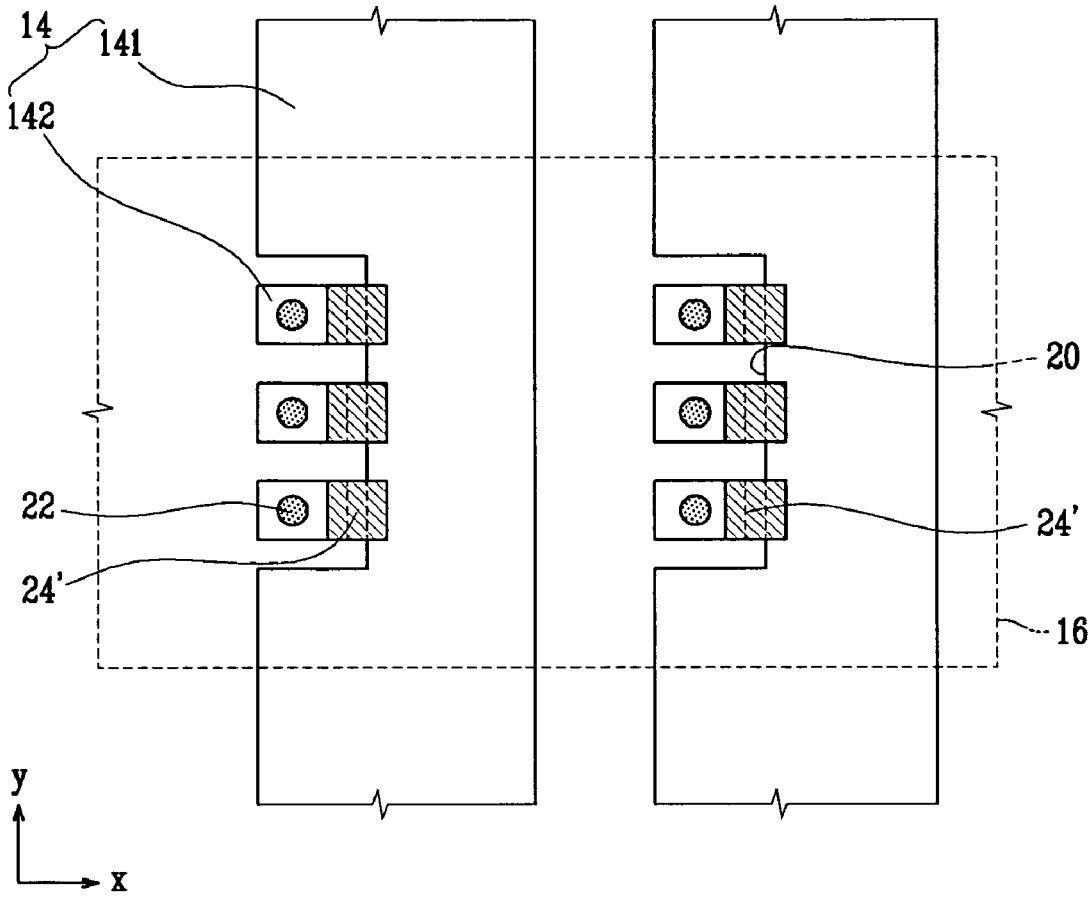
FIG. 4 is a partial amplified plan view of an electron emission device according to a second embodiment of the present invention.

As shown in FIG. 3, the resistance layer 24 may be separately formed at the respective grooves 20 such that it contacts all the isolation electrodes 142. Also, with an electron emission device according to a second embodiment of the present invention, as shown in FIG. 4, a resistance layer 24' may be separately disposed between the respective isolation electrodes 142 and the line electrodes 141 neighboring thereto. With the electron emission devices according to the first and second embodiments of the present invention, the resistance layers 24 and 24' partially cover the top surface of the line electrodes 141 and the top surface of the isolation electrodes 142, thereby minimizing the contact resistance thereof with the cathode electrodes 14.

The electron emission regions 22 may be formed with a material for emitting electrons when an electric field is applied thereto under a vacuum atmosphere, such as a carbonaceous material or a nanometer size material. For instance, the electron emission regions 22 may be formed with carbon nanotube (CNT), graphite, graphite nanofiber, diamond, diamond-like carbon (DLC), fullerene ($C_{60}$), silicon nanowire, or combinations thereof. Alternatively, the electron emission regions 22 may be formed with a sharp-pointed tip structure formed with molybdenum or silicon.

Opening portions 181 and 161 are formed in the first insulating layer 18 and the gate electrodes 16 corresponding to the respective electron emission regions 22 to expose the electron emission regions 22 on the first substrate 10.

A focusing electrode 26 is formed on the gate electrodes 16 and the first insulating layer 18 and is referred to as a third electrode. A second insulating layer 28 is placed under the focusing electrode 26 to insulate the focusing electrode 26 from the gate electrodes 16. Opening portions 281 and 261 are formed at the second insulating layer 28 and the focusing electrode 26 to pass the electron beams. The opening portions 281 and 261 are provided per respective pixels on a one to one basis such that the focusing electrode 26 may collectively focus the electrons emitted for each pixel.

With the above structure, one cathode electrode 14, one gate electrode 16, the first insulating layer 18, the second insulating layer 28, the isolation electrodes 142, the resistance layers 24 or 24', and the electron emission regions 22 at the crossed region of the cathode and gate electrodes 14 and 16 form an electron emission element, and arrays of electron emission elements are arranged on the first substrate 10 to thereby form the electron emission device 40.

Referring back to FIGS. 1 and 2, a light emission unit 50 is formed on a surface of the second substrate 12 facing the first substrate 10. The light emission unit 50 includes phosphor layers 30 including red, green, and blue phosphor layers 30R, 30G, and 30B spaced apart from each other with a certain (or predetermined) distance, black layers 32 disposed between the respective phosphor layers 30 to enhance screen contrast, and an anode electrode 34 formed on the phosphor layers 30 and the black layers 32 with a metallic material formed with aluminum (Al).

The phosphor layers 30 are formed on the second substrate 12 such that the respective color phosphor layers 30R, 30G, and 30B correspond to the respective pixels of the first substrate 10. As shown in FIG. 2, the central portions C of the phosphor layers 30 (or 30R, 30G, and 30B) defined along the longitudinal direction of the line electrode 141 (in the y axis direction) correspond to the relevant electron emission regions 22 such that the electrons emitted from the electron emission regions 22 collide with (or land on) the center portions C of the phosphor layers 30.

The anode electrode 34 receives a high voltage required for accelerating the electron beams from an external source, and causes the phosphor layers 30 to be in a high potential state. In one embodiment, the anode electrode 34 also reflects the visible rays radiated from the phosphor layers 30 to the first substrate 10 back toward the second substrate 12, thereby heightening the screen luminance.

Alternatively, the anode electrode 34 may be formed with a transparent conductive material, such as indium tin oxide (ITO). In this case, the anode electrode 34 is disposed between the second substrate 12 and the phosphor and black layers 30 and 32. In addition, a transparent conductive layer and a metallic layer may be simultaneously formed to make the anode electrode 34.

As shown in FIG. 2, spacers 36 are arranged between the first and second substrates 10 and 12 to endure the pressure applied to the vacuum vessel, and to space the first and second substrates 10 and 12 away from each other at a certain (or predetermined) distance. The spacers 36 are placed at the area of the black layer 32 such that they do not intrude upon the area of the phosphor layers 30.

With the above-structured electron emission display 2, voltages (which may be predetermined) are externally applied to the cathode electrodes 14, the gate electrodes 16, the focusing electrode 26, and the anode electrode 34 to drive the display. For instance, when the cathode electrode 14 receives a scanning driving voltage to function as the scanning electrode, the gate electrode 16 receives a data driving voltage to function as the data electrode (or vise versa). The focusing electrode 26 receives 0V or a negative direct current voltage ranging from several to several tens of volts required for focusing the electron beams. The anode electrode 34 receives a voltage required for accelerating the electron beams, for instance, a positive direct current voltage ranging from several hundreds to several thousands of volts.

Then, electric fields are formed around the electron emission regions 22 at the pixels where the voltage difference between the cathode and gate electrodes 14 and 16 exceeds the threshold value, and electrons are emitted from these electron emission regions 22. The emitted electrons pass through the focusing electrode opening portions 261, and are centrally focused into a bundle of electron beams. The electron beams are attracted by the high voltage applied to the anode electrode 34, thereby colliding with (or landing on) the relevant phosphor layers 30 at the pixels corresponding thereto.

With the above driving process, as the grooves 20 are formed at the one lateral side surface of the line electrodes 141 and the isolation electrodes 142 are placed in the respective grooves 20 and electrically connected to the line electrodes 141 via the resistance layer 24, a sufficient effective width, indicated by D1, is obtained at each pixel, as shown in FIG. 3.

With the enlargement in effective width of the cathode electrodes 14, the resistance thereof is reduced to thereby reduce or prevent the voltage drop of the cathode electrodes 14. The effective width of Dl is minimized within the range that does not induce an increase in resistance to thereby achieve the desired high resolution display screen.

Figure 5:
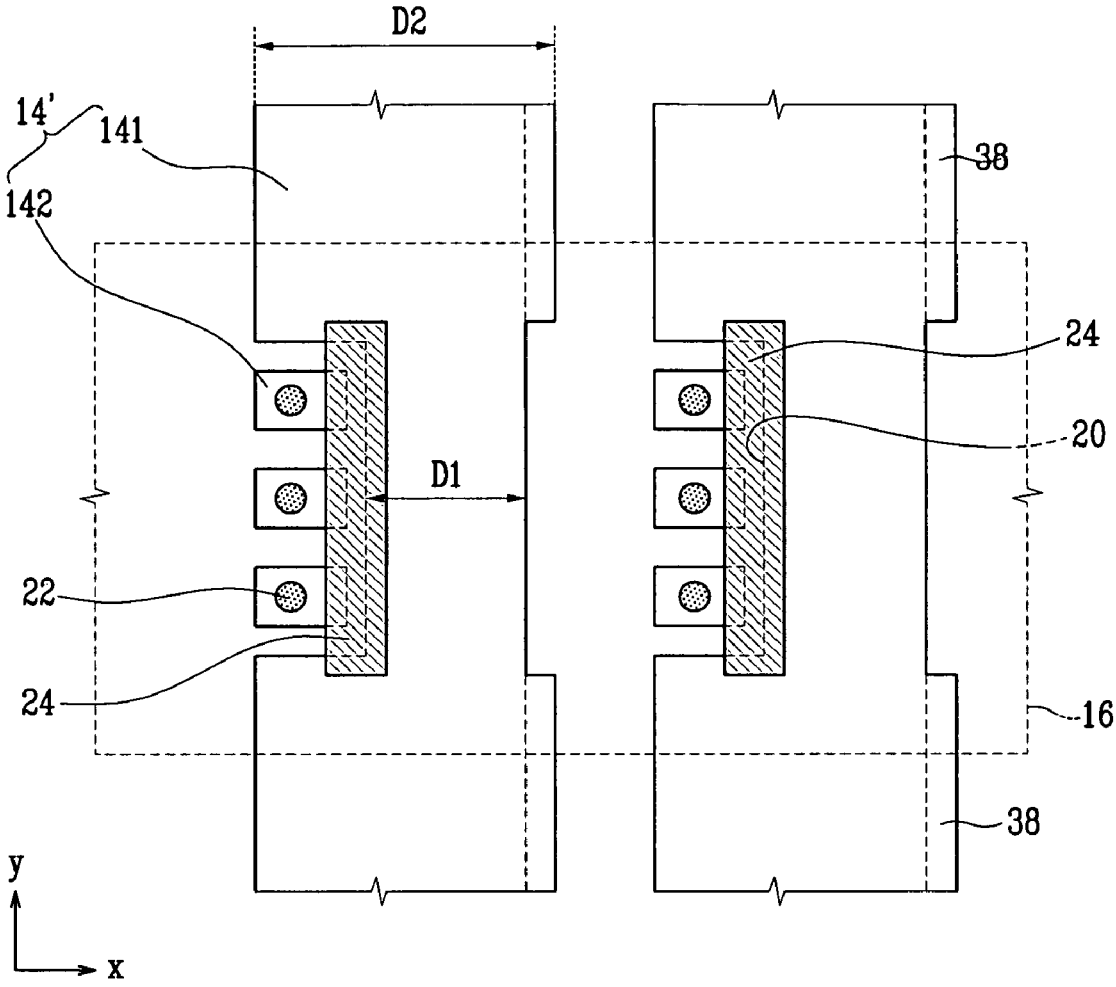
FIG. 5 is a partial amplified plan view of an electron emission device according to a third embodiment of the present invention.

FIG. 5 is a partial plan view of an electron emission device according to a third embodiment of the present invention. As shown in FIG. 5, the cathode electrodes 14' have an effective width D1 at each pixel, and a width D2 between the pixels, which is larger than the effective width D1. That is, the cathode electrodes 14' have protrusions 38 formed at the respective non-pixel regions on the opposite side to the grooves 20. In this case, the maximum width of the cathode electrodes 14' is further enlarged to further increase the flow of the electric current (or to further decrease the resistance).

Embodiments of the present invention have been explained in relation to a field emitter array (FEA) type of electron emission element where the electron emission regions are formed with a material for emitting electrons when electric fields are applied thereto under a vacuum atmosphere. However, the present invention is not limited to the FEA type of electron emission elements, and may be applied to other types of electron emission elements.

With an electron emission display according to an embodiment of the present invention, cathode electrodes include a structure formed with line and isolation electrodes connected via one or more resistance layers to have a sufficient effective width at each pixel to reduce the resistance of the cathode electrodes to thereby reduce or prevent a voltage drop, and to also achieve a high resolution display screen.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

a substrate;

a plurality of cathode electrodes formed on the substrate;

a plurality of gate electrodes insulated from the cathode electrodes; and a plurality of electron emission regions electrically connected to the cathode electrodes, wherein each of the cathode electrodes comprises:

a line electrode having a groove at one lateral side surface thereof;

a plurality of isolation electrodes formed on the substrate exposed through the groove such that the isolation electrodes are isolated from the line electrode, the electron emission regions being placed on the isolation electrodes; and a resistance layer electrically connecting the isolation electrodes to the line electrode.

2. The electron emission device of claim 1, wherein the resistance layer is separately formed at the groove to connect the isolation electrodes to the line electrode.

3. The electron emission device of claim 2, wherein the isolation electrodes are serially arranged along a longitudinal direction of the line electrode.

4. The electron emission device of claim 1, wherein the resistance layer comprises a plurality of separate layers respectively provided to the isolation electrodes to connect each of the isolation electrodes to the line electrode.

5. The electron emission device of claim 4, wherein the isolation electrodes are serially arranged along a longitudinal direction of the line electrode.

6. The electron emission device of claim 1, wherein the line electrode has a plurality of protrusions at another lateral side surface thereof opposite to the groove, and wherein the protrusions are placed at areas not corresponding to the groove.

7. The electron emission device of claim 1, further comprising a focusing electrode placed over the gate electrodes such that the focusing electrode is insulated from the gate electrodes.

8. The electron emission device of claim 1, wherein the electron emission regions comprise a material selected from the group consisting of carbon nanotube (CNT), graphite, graphite nanofiber, diamond, diamond-like carbon (DLC), fullerene ($C_{60}$), silicon nanowire, and combinations thereof.

9. An electron emission display comprising:

an electron emission device comprising:

a first substrate, a plurality of cathode electrodes formed with a plurality of gate electrodes on the first substrate such that the cathode electrodes and the gate electrodes are insulated from each other, and a plurality of electron emission regions electrically connected to the cathode electrodes, wherein each of the cathode electrodes comprises:

a line electrode having a groove at one lateral side surface thereof;

a plurality of isolation electrodes formed on the first substrate exposed through the groove such that the isolation electrodes are isolated from the line electrode, the electron emission regions being placed on the isolation electrodes; and a resistance layer for electrically connecting the isolation electrodes to the line electrode;

a second substrate facing the first substrate; and a plurality of phosphor layers formed on a surface of the second substrate facing the first substrate.

10. The electron emission display of claim 9, wherein the isolation electrodes are serially arranged along a longitudinal direction of the line electrode.

11. The electron emission display of claim 9, wherein a plurality of central portions of the phosphor layers along a longitudinal direction of the line electrode correspond to the electron emission regions.

12. The electron emission display of claim 9, wherein the resistance layer is separately formed at the groove to connect the isolation electrodes to the line electrode.

13. The electron emission display of claim 12, wherein the isolation electrodes are serially arranged along a longitudinal direction of the line electrode.

14. The electron emission display of claim 9, wherein the resistance layer comprises a plurality of separate layers respectively provided to the isolation electrodes to connect each of the isolation electrode to the line electrodes.

15. The electron emission display of claim 14, wherein the isolation electrodes are serially arranged along a longitudinal direction of the line electrode.

16. The electron emission display of claim 9, wherein the line electrode has a plurality of protrusions at another lateral side surface thereof opposite to the groove, and wherein the protrusions are placed at areas not corresponding to the groove.

17. The electron emission display of claim 9, further comprising a focusing electrode placed over the gate electrodes such that the focusing electrode is insulated from the gate electrodes.

18. The electron emission display of claim 9, wherein the electron emission regions comprise a material selected from the group consisting of carbon nanotube (CNT), graphite, graphite nanofiber, diamond, diamond-like carbon (DLC), fullerene ($C_{60}$), silicon nanowire, and combinations thereof.

19. An electron emission device comprising:

a substrate;

a cathode electrode formed on the substrate;

a gate electrode insulated from the cathode electrode; and an electron emission region electrically connected to the cathode electrode, wherein the cathode electrode comprises:

a line electrode having a groove at one lateral side surface thereof;

an isolation electrode formed on the substrate exposed through the groove such that the isolation electrode is isolated from the line electrode, the electron emission region being placed on the isolation electrode; and a resistance layer electrically connecting the isolation electrode to the line electrode.

20. The electron emission device of claim 19, wherein the resistance layer comprises a material having a specific resistivity ranging from 10,000 to 100,000 Ωcm.

* * * * *

UNITED STATES PATENT AND TRADEMARK OFFICE

CERTIFICATE OF CORRECTION

PATENT NO. : 7,541,725 B2
APPLICATION NO. : 11/541037
DATED : June 2, 2009
INVENTOR(S) : Jin-Hui Cho et al.

It is certified that error appears in the above-identified patent and that said Letters Patent is hereby corrected as shown below:

Column 8, Claim 14, line 22 Delete "electrode" Insert -- electrodes --

Signed and Sealed this

Twenty-third Day of November, 2010

David J. Kappos

David J. Kappos
*Director of the United States Patent and Trademark Office*